US007122286B2

(12) United States Patent
Suzuki et al.

(10) Patent No.: US 7,122,286 B2
(45) Date of Patent: Oct. 17, 2006

(54) TONER FOR DEVELOPMENT OF ELECTROSTATIC LATENT IMAGES, METHOD OF FORMING IMAGES, IMAGE FORMATION APPARATUS, TONER CONTAINER CONTAINING THE TONER THEREIN, AND IMAGE FORMATION APPARATUS EQUIPPED WITH THE TONER CONTAINER

(75) Inventors: Masanori Suzuki, Shizuoka (JP); Yohichiroh Watanabe, Shizuoka (JP); Masahide Yamashita, Shizuoka (JP); Kazuhito Watanabe, Shizuoka (JP); Keiko Shiraishi, Shizuoka (JP); Kohki Katoh, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/826,789

(22) Filed: Apr. 5, 2001

(65) Prior Publication Data

US 2003/0036010 A1 Feb. 20, 2003

(30) Foreign Application Priority Data

Apr. 5, 2000 (JP) ..... 2000-103207

(51) Int. Cl.
*G03G 9/083* (2006.01)

(52) U.S. Cl. ..... 430/109.4; 430/106.1; 430/106.2; 399/274; 399/284

(58) Field of Classification Search ..... 430/106.1, 430/106.2, 106.3, 108.9, 109.4, 111.41, 120, 430/122, 111.4; 399/58, 274, 284
See application file for complete search history.

(56) References Cited

U.S. PATENT DOCUMENTS 4,699,865 A * 10/1987 Mitsuhashi ..... 430/101
5,532,095 A * 7/1996 Asanae et al. ..... 430/106.2
5,733,699 A * 3/1998 Asanae et al. ..... 430/111.41
5,771,426 A * 6/1998 Oka et al. ..... 399/274
5,805,965 A * 9/1998 Tsuda et al. ..... 399/281
5,866,289 A * 2/1999 Asanae et al. ..... 430/122
6,335,137 B1 * 1/2002 Suzuki et al. ..... 430/110.1
6,593,048 B1 * 7/2003 Sasaki et al. ..... 430/106.1
2002/0090562 A1 * 7/2002 Sasaki et al. ..... 430/106.1

FOREIGN PATENT DOCUMENTS

EP 0936507 A2 * 8/1999
FR 2795190 * 12/2000
JP 5-66609 * 3/1993 ..... 430/106.2

OTHER PUBLICATIONS

Japanese Patent Office Machine-Assisted Translation of JP 5-66609 (pub Mar. 1993).*
Diamond, A S. ed. *Handbook of Imaging Materials*, Marcel Dekker, Inc., NY (1991), pp. 162-165.*
Diamond, A.S. ed. *Handbook of Imaging Materials*, Marcel Dekker, Inc., NY (1991), pp. 165-168.*
European Patent Abstract Database English-language abstract describing FR 2,795,190 (pub. Dec. 2000).*

* cited by examiner

*Primary Examiner*—Janis L. Dote
(74) *Attorney, Agent, or Firm*—Cooper & Dunham LLP

(57) ABSTRACT

A toner for developing a latent electrostatic image to a toner image, including a binder resin, and a magnetic material which is blackened by coating the surface of a magnetic powder with a coloring agent, the magnetic material being in an amount of 10 wt.% to 40 wt.% of the entire weight of the toner, a method of forming an image, using a two-component developer containing the toner, an image formation apparatus using the two-component developer, and a toner container containing therein the toner, and an image formation apparatus equipped with the toner container are proposed.

4 Claims, 1 Drawing Sheet

TONER FOR DEVELOPMENT OF ELECTROSTATIC LATENT IMAGES, METHOD OF FORMING IMAGES, IMAGE FORMATION APPARATUS, TONER CONTAINER CONTAINING THE TONER THEREIN, AND IMAGE FORMATION APPARATUS EQUIPPED WITH THE TONER CONTAINER

BACKGROUND OF THE INVENTION

1. Field of the Invention

The present invention relates to a toner for use in an image forming process such as an electrophotographic process or electrostatic printing process.

The present invention also relates to a method of forming an image, using a two-component developer comprising the above-mentioned toner and a magnetic carrier.

The present invention also relates to an image formation apparatus, using the two-component developer comprising the above-mentioned toner.

The present invention also relates to a container containing therein the above-mentioned toner.

The present invention also relates to an image formation apparatus equipped with the container containing therein the above-mentioned toner.

2. Discussion of Background

A dry type two-component developer for use in a two-component type development method comprises a carrier composed of relatively large particles (hereinafter referred to as the carrier particles), and a toner composed of fine particles (hereinafter referred to as the toner particles) which toner particles are triboelectrically held on the surface of the relatively large carrier particles.

When the developer comes near a latent electrostatic image, the attraction of the toner particles to the latent electrostatic image overcomes the bonding force between the toner particles and the carrier particles, so that the toner particles are attracted to the latent electrostatic image and deposited thereon, whereby the latent electrostatic image is developed to a visible toner image. The developer is repeatedly used with the replenishment of the toner thereto as the toner is consumed by the development of latent electrostatic images.

Conventional toners for use in two-component developers are mostly of a non-magnetic type, in which carbon black is used as a coloring agent. Such conventional toners have a shortcoming that the fogging of images is apt to be caused when the carrier serving as a charge application member deteriorates while in use, and applies to the toner particles electric charges with a polarity opposite to the polarity of electric charges that should be applied to the toner particles, or when the toner particles are not sufficiently charged by the carrier.

As a countermeasure against such a problem, there has been devised a method for preventing the occurrence of the fogging of images by containing a magnetic material in the toner and applying a magnetic bias thereto. However, when the amount of the magnetic material is excessive in the toner, images with a sufficient density for use in practice cannot be obtained so that an appropriate range of the amount thereof must be found, while when the amount of the magnetic material is small, carbon black must be used in combination with the magnetic material since the coloring is insufficient when only the magnetic material is used. However, in order to improve the coloring degree, a large amount of carbon black is used, there occurs a problem that the tolerance for the image fogging is reduced.

A heat roller system for application of heat application is widely and generally used as an image fixing system in electrophotography due to the advantage of energy efficiency thereof over other image fixing systems.

Recently, there is a tendency that thermal energy applied to the toner at the time of fixing toner images is reduced because of the recent development of the low-temperature image fixing and high speed copying for rational use of energy.

The improvement of the low-temperature image fixing performance of such a toner for use in the low-temperature image fixing has been generally tried by use of resins with low softening points and waxes. However, such toners for use in the low-temperature image fixing are vulnerable to heat, so that it is known that such toners are solidified by the heat applied mechanically or the heat applied during the storage thereof, which is known as the so-called blocking. Furthermore, it is difficult for such toners to attain a sufficient image fixing temperature range for use in practice. Such problems have not yet been solved even by use of polyester resin, which is said to have relatively good heat retention performance for its good low-temperature image fixing performance.

In order to solve these problems, there have been made several proposals to use two kinds of polyester resins with different characteristics in combination.

For example, in Japanese Laid-Open Patent Application No. 60-90344, there is proposed a method of mixing a non-linear polyester resin and a linear polyester resin.

In Japanese Laid-Open Patent Application No. 64-15755, there is proposed a method of mixing a cross-linked polyester resin with Tg of 50° C. or more and a softening point of 200° C. or less, and a straight chain polyester resin with a softening point of 150° C. or less and MW of 3,000 to 50,000.

In Japanese Laid-Open Patent Application No. 2-82267, there is proposed a method of containing a non-linear polyester resin with MW of 5,000 or more and a dispersion ratio of 20 or more, and a linear polyester resin with MW of 1,000 to 5,000 and a dispersion ratio of 4 or less.

In Japanese Laid-Open Patent Application No. 3-229264, there is proposed a method of containing an organometallic compound composed of a linear polyester resin with an acid value of 5 to 60 and a non-linear polyester resin with an acid value of less than 5.

In Japanese Laid-Open Patent Application No. 3-41470, there is proposed a method of mixing saturated polyester resins with the difference between the acid values thereof being 1.5 or more.

Due to the recent further developed low-temperature image fixing, a demand for more advanced low-temperature image fixing performance, and a significant reduction in size of image fixing unit, it is extremely difficult to secure a further advanced low-temperature image fixing performance, an extended image fixing temperature range, and thermal preservation performance at the same time when an image fixing unit which used a light load.

Furthermore, in the two-component development method, it is necessary that the mixing ratio of carrier and toner, namely, toner concentration, be constant in order to obtain a stable image density. In order to achieve this, it is necessary to mount a toner replenishing mechanism, a sensor and other devices on the image development unit. These devices make the development unit large and the operation thereof complex. These are the shortcomings of the two-component development method.

In contrast to this, in the mono-component development method, such a developer as composed of a mixture of carrier particles and toner particles is not used as in the two-component development method, but a toner composed of toner particles is held on a development sleeve by electric force generated triboelectrically between the toner and the development sleeve, or by magnetic force generated between a magnetic-material-containing toner and a magnet-built-in development sleeve, so that when the toner particles come near a latent electrostatic image, the attraction of the latent electrostatic image for the toner particles overcomes the bonding force between the toner particles and the development sleeve and the toner particles are deposited on the latent electrostatic image, whereby the latent electrostatic image is developed to a visible toner image.

Therefore, it is unnecessary to control the toner concentration in the mono-component development method and therefore the development unit for the mono-component development method can be advantageously reduced in size.

However, in the mono-component development, the number of toner particles in the development area is smaller than that in the development area in the two-component development, a sufficient amount of toner cannot be supplied to a photoconductor in the mono-component development method and therefore it has been difficult to apply the mono-component development method to a high speed copying machine.

In contrast to the above, there is known a development unit which is capable of incorporating the toner into the two-component developer in accordance with the movement of the developer, without the necessity for a toner concentration detector. This development unit, however, has the shortcoming that the amount of the toner incorporated differs in the place where the developer moves actively, and in the place where the developer does not move actively, and also in the place where there is a large amount of the developer and in the place where there is not much developer, making places where the toner concentration is partially non-uniform, thus, non-uniform image density and toner deposition on the background of images are apt to be caused.

In order to solve the above-mentioned problems, in Japanese Laid-Open Patent Application No. 63-4282, there is disclosed a method of disposing two toner replenishing members within a toner hopper so as to allow the developer to pass through the routes formed by the two toner replenishing members, whereby non-uniform image density and the deposition of the toner on the background of images in the longitudinal direction of the development unit are prevented.

The above disclosed method, however, has the shortcomings that the use of the two toner replenishing members makes the development unit large and expensive.

In Japanese Laid-Open Patent Application No. 9-197833, there is disclosed a method of eliminating the problems in the above-mentioned method. However, the method disclosed therein is not yet capable of completely solving the problem of the non-uniform image density.

Furthermore, in recent years, higher image quality is demanded on the market, and the demand cannot be met by use of a conventional toner with a volume mean particle diameter of 10 μm to 15 μm. There is a keen customer demand for a toner with a smaller particle diameter.

SUMMARY OF THE INVENTION

It is therefore a first object of the present invention to provide a toner for developing latent electrostatic images to visible toner images, from which the above-mentioned conventional problems have been eliminated, and which is capable of providing high quality images.

The second object of the present invention is to provide a method of forming an image, using a two-component developer comprising the above-mentioned toner and a magnetic carrier, from which the above-mentioned conventional problems have been eliminated, and which is capable of providing high quality images.

The third object of the present invention is to provide an image formation apparatus, using the two-component developer comprising the above-mentioned toner, with the apparatus being reduced in terms of the number of parts therefor, the size and the cost thereof, with the functions thereof being intensified.

The fourth object of the present invention is to provide a container containing therein the above-mentioned toner.

The fifth object of the present invention is to provide an image formation apparatus equipped with the container containing therein the above-mentioned toner.

The first object of the present invention can be achieved by a toner for developing a latent electrostatic image to a toner image, comprising (a) a binder resin, and (b) a magnetic material which is blackened by coating the surface of a magnetic powder with a coloring agent, the magnetic material being in an amount of 10 wt. % to 40 wt. % of the entire weight of the toner.

It is preferable that the coloring agent for use in the above-mentioned toner comprise a pigment and/or a dye.

As the pigment, carbon black can be employed.

In the above-mentioned toner, the magnetic material can be blackened by carbon black which serves as the coloring agent and it is preferable that the magnetic material blackened by carbon black be in an amount of 10 wt. % to 30 wt. % of the entire weight of the toner.

When the above toner contains carbon black on the inside thereof, it is preferable that the amount of the carbon black be in a range of 6 wt. % or less of the entire amount of the toner.

In the above-mentioned toner, it is preferable that the magnetic material have an average particle diameter in a range of 0.20 μm to 0.40 μm.

Furthermore, it is preferable that the above-mentioned toner have a saturation magnetization of 10 emu/g to 25 emu/g.

In the above-mentioned toner, it is preferable that the binder resin comprise a polyester resin, and have such a molecular weight distribution that has at least one peak within a range of 1,000 to 10,000 in said molecular weight distribution and a half peak width of 15,000 or less in terms of the molecular weight thereof, which molecular weight distribution is determined by subjecting a THF-soluble component contained in the toner to gel permeation chromatography (GPC), and that the toner contain therein a THF-insoluble component in an amount of 2 wt. % to 40 wt. % of the toner.

It is also preferable that the above-mentioned toner have a volume mean diameter of 2.5 μm to 10 μm.

The second object of the present invention can be achieved by a method of forming an image, using a two-component comprising the above-mentioned toner and a magnetic carrier by a development unit which is capable of changing the state of incorporation of the toner by the developer on a developer bearing member by changing the state of the contact of the developer and the toner in accordance with the changes in the concentration of the toner in the developer on the developer bearing member.

The third object of the present invention can be achieved by an image formation apparatus comprising a development unit, using a two-component developer comprising the above-mentioned toner and a magnetic carrier, which development unit is capable of changing the state of incorporation of the toner by the developer on a developer bearing member by changing the state of the contact of the developer and the toner in accordance with the changes in the concentration of the toner in the developer on the developer bearing member.

The fourth object of the present invention can be achieved by a container in which the above-mentioned toner is contained.

The fifth object of the present invention can be achieved by an image formation apparatus equipped with the above-mentioned container.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
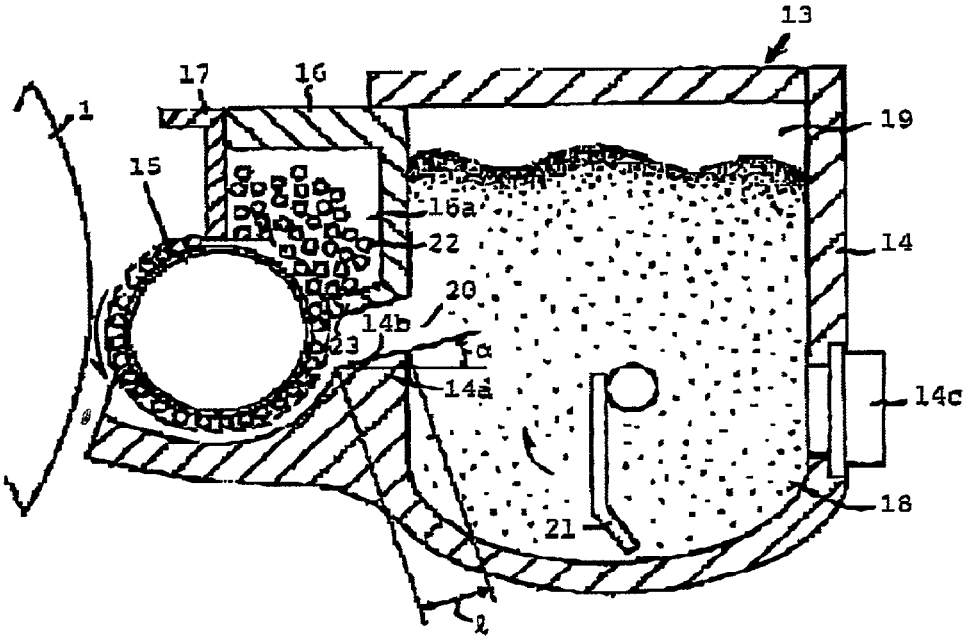
FIG. 1 is a schematic cross-sectional view of an image formation apparatus of the present invention.

The toner of the present invention comprises (a) a binder resin, and (b) a magnetic material which is blackened by coating the surface of a magnetic powder with a coloring agent, the magnetic material being in an amount of 10 wt. % to 40 wt. % of the entire weight of the toner.

In the above-mentioned toner of the present invention, by containing in the toner the magnetic material of which blackness is increased by the surface of the magnetic power being coated with the coloring agent, the use of carbon black constitutes one of the causes of bringing about the fogging of the background of images can be eliminated or reduced, or the bias response of a toner with a small charge quantity due to magnetic bias effect, or due to opposite polarity charging can be reduced, so that the tolerance for the fogging of the background can be improved.

In the above toner, when the amount of the magnetic material is less than 10 wt. %, the improvement effect of the fogging of the background due to the magnetic bias effect is small, while when the amount of the magnetic material is more than 40 wt. %, the magnetic bias effect becomes so excessive that the development performance is extremely reduced and a problem may occur with respect to image density.

It is preferable that the coloring agent comprise a pigment and/or a dye.

In particular, when the pigment is carbon black, a magnetic material with high blackness can be obtained, so that by a small amount of the coating on the magnetic powder, a magnetic material with a desired blackness can be advantageously obtained.

It is preferable that the amount of the magnetic material, which is blackened by carbon black, be in an amount of 10 wt. % to 30 wt. % of the entire weight of the toner for achieving the first object of the present invention.

When the toner contains carbon black on the inside thereof, it is preferable that the amount of the carbon black be in a range of 6 wt. % or less of the entire amount of the toner. When the amount of the carbon black contained inside the toner is more than 6 wt. %, the fogging of the background of image may occur. The smaller the amount of the carbon back, the more the fogging of the background is improved. The best is that no carbon black is contained inside the toner from the viewpoint of the occurrence of the fogging of the background.

It is preferable that the magnetic material have an average particle diameter in a range of 0.20 μm to 0.40 μm, since when the average particle diameter of the magnetic material is in this range, the magnetic material can be appropriately dispersed in the resin so that the magnetic material can be used instead of a black coloring agent such as carbon black, with a sufficient coloring degree.

When the average particle diameter of the magnetic material is less than 0.20 μm, the magnetic material tends to aggregate within the resin, or the fogging of the background of image caused by the poor dispersion of the magnetic material occurs, while when the average particle diameter of the magnetic material is more than 0.40 μm, a problem occurs with respect to the coloring degree.

It is preferable that the toner have a saturation magnetization of 10 emu/g to 25 emu/g, more preferably 12 emu/g to 22 emu/g. When the saturation magnetization is less than 10 emu/g, the improvement effect of the fogging of the background due to the magnetic bias effect is low, while when the saturation magnetization is more than 25 emu/g, the magnetic bias effect is so great that the development performance extremely drops, and a problem is caused with respect to image density.

It is preferable that the binder resin comprise as the main component a polyester resin, and have such a molecular weight distribution that has at least one peak within a range of 1,000 to 10,000 in the molecular weight distribution and a half peak width of 15,000 or less in terms of the molecular weight thereof, which molecular weight distribution is determined by subjecting a THF-soluble component contained in the toner to gel permeation chromatography (GPC), and it is preferable that the toner contain therein a THF-insoluble component in an amount of 2 wt. % to 40 wt. % of the toner. This is because when the above conditions are met, there can be obtained a toner which is capable of performing the low-temperature image fixing and is free from the problem of the toner deposition on the background of image.

It is preferable that the toner particles of the toner have a volume mean diameter of 2.5 μm to 10 μm in order to obtain images with high quality which are excellent in the reproducibility of thin line images, although there is no particular limitation to the diameter of the toner particles.

When the particular magnetic material as used in the present invention is contained in the toner, the toner can be easily pulverized when the toner is produced, so that the particle diameter of the toner particles can be easily reduced and therefore high quality images can be easily obtained.

The volume mean diameter of toner particles can be measured by various methods. In the present invention, "COULTER COUNTER MODEL TA-II" (trademark) particle counting and analyzing apparatus, which is available from Coulter Electronics Inc., is used for the measurement of the volume mean diameter of the toner particles.

Furthermore, the present invention provides a method of forming an image, using a two-component comprising a toner and a magnetic carrier by a development unit which is capable of changing the state of incorporation of the toner by the developer on a developer bearing member by changing the state of the contact of the developer and the toner in accordance with the changes in the concentration of the toner in the developer on the developer bearing member, wherein the toner comprises (a) a binder resin, and (b) a magnetic material which is blackened by coating the surface of a magnetic powder with a coloring agent.

From this method, the above-mentioned conventional problems have been eliminated.

Generally, in the case where a magnetic toner is used in the two-component development, if there is used a magnetic toner which is highly magnetized as used in a conventional magnetic mono-component developer, the magnetic toner has a problem that the development performance thereof extremely drops unlike in the case of the mono-component development, and a desired image density cannot be obtained. When the content of the magnetic material in the toner is decreased and the magnetization of the toner is reduced in order to solve this problem, even if the toner is used in the two-component development, the desired image density can be obtained. However, the degree of blackness thereof is reduced due to the reduction in the content of the magnetic material. When a black pigment such as carbon black, which is used in the conventional two-component developer, is contained in order to improve the degree of blackness, the tolerance for the fogging of the background is lowered.

In particular, in the image formation method of the present invention which does not require means for detecting the concentration of the toner, higher improvement of the tolerance for the unevenness of image density and the fogging of the background of image is required.

It is preferable that the coloring agent for blackening the magnetic powder for in the present invention comprise a pigment and/or a dye. In particular, when the coloring agent comprises carbon black, a magnetic material with high degree of blackness can be obtained, so that the desired blackness can be advantageously obtained by a small amount of coating of the coloring agent on the magnetic powder.

Furthermore, the present invention provides an image formation apparatus comprising a development unit, using a two-component developer comprising a toner and a magnetic carrier, which development unit is capable of changing the state of incorporation of the toner by the developer on a developer bearing member by changing the state of the contact of the developer and the toner in accordance with the changes in the concentration of the toner in the developer on the developer bearing member, wherein the above-mentioned toner comprises (a) a binder resin, and (b) a magnetic material which is blackened by coating the surface of a magnetic powder with a coloring agent.

From this image formation apparatus, the above-mentioned conventional problems have been eliminated.

A specific example of the image formation apparatus of the present invention comprises a development unit which is provided with (a) a developer bearing member including inner magnetic field generation means, which developer bearing member carries thereon a two-component developer comprising a toner and a carrier, (b) a first regulating member for regulating the amount of the developer carried by the developer bearing member by scraping the developer therefrom, (c) a developer holding portion for holding therein the developer scraped by the first regulating member, and (d) a toner holding portion which is situated adjacent to the above-mentioned developer holding portion, and from which the toner is supplied to the above-mentioned developer bearing member, whereby the development unit is capable of changing the incorporation state of the toner into the developer on the above-mentioned developer bearing member, with the state of the contact of the developer and the toner being changed, in accordance with the changes in the concentration of the toner in the developer on the developer bearing member, with the developer holding portion having a second regulating member which is disposed upstream from the first regulating member in the direction of the transportation of the developer on the developer bearing member, the second regulating member having a gap from the developer bearing member so as to regulate the passage of an increased portion of the developer when the concentration of the toner in the developer on the developer bearing member is increased and the thickness of a layer of the developer is increased, in which development unit, when the developer is moved within the developer holding portion regardless of the changes in the concentration of the toner in the developer on the developer bearing member, and the concentration of the toner in the developer on the developer bearing member reaches a predetermined toner concentration, the developer for which passage is regulated by the second regulating member is held in a contacting portion of the developer on the above-mentioned developer bearing member and the above-mentioned toner, so that the contacting portion is blocked with the developer, whereby the incorporation of the toner by the developer on the developer bearing member is stopped, wherein the toner used in this image formation apparatus comprises a binder resin, a magnetic-powder, and a coloring agent, wherein the surface of the magnetic powder is coated with the coloring agent and blackened thereby, constituting a magnetic material.

In the above image formation apparatus, the uniformity of the image density is improved by facilitating the movement of the toner in the traverse direction. The greater the binding force applied to the toner which is held to a development sleeve by magnetic force, the more difficult for the toner to move, and the more conspicuously the non-uniformity of the image density appears. Therefore, the less the binding force to the toner, the better. In order to reduce the fogging of the background of image due to the magnetic bias and the non-uniformity of the density at the same time, it is necessary to control the magnetic force of the toner itself within a specific range. The magnetic force of the toner can be controlled by controlling the amount of a magnetic material to be contained in the toner. However, when the amount of the magnetic material is reduced below a level corresponding to the level of the conventional magnetic toner in general use, there arises a problem that the coloring force is reduced. When the coloring force is improved by containing carbon black in the toner, the tolerance for the fogging of the background of image is lowered. In the present invention, it has been discovered that the desired coloring degree is obtained and the non-uniformity of image density and the fogging of the background of image can be controlled appropriately at the same time by containing in the toner the magnetic material whose surface is coated with a coloring agent and blackened with the coloring agent, even if the amount of the blackened magnetic material is small.

In the image formation apparatus of the present invention, it is preferable that the magnetic material be in an amount of 10 wt. % to 40 wt. % of the entire weight of the toner in order to eliminate the above-mentioned conventional problems.

When the amount of the magnetic material is less than 10 wt. %, the improvement effect of the fogging of the background due to the magnetic bias effect is small, while when the amount of the magnetic material is more than 40 wt. %, the magnetic bias effect becomes so excessive that the development performance is extremely reduced and a problem was found in terms of the image density.

In the above image formation apparatus, it is preferable that the coloring agent used for blackening the magnetic powder to prepare the magnetic material comprise a pigment and/or a dye.

In particular, when the pigment is carbon black, a magnetic material with high blackness can be obtained, so that by a small amount of the coating on the magnetic powder, a magnetic material with a desired blackness can be advantageously obtained.

Furthermore, in the above-mentioned image formation apparatus of the present invention, it is preferable that the amount of the magnetic material, which is blackened by carbon black, be in an amount of 10 wt. % to 30 wt. % of the entire weight of the toner for eliminating the above-mentioned conventional problems.

Furthermore, in the above-mentioned image formation apparatus of the present invention, when the toner contains carbon black on the inside thereof, it is preferable that the amount of the carbon black be in a range of 6 wt. % or less of the entire amount of the toner. When the amount of the carbon black contained inside the toner is more than 6 wt. %, the fogging of the background of image may occur due to the carbon black contained. The smaller the amount of the carbon back, the more the fogging of the background is improved. The best is that no carbon black is contained inside the toner from the viewpoint of the occurrence of the fogging of the background.

Furthermore, in the above-mentioned image formation apparatus of the present invention, it is preferable that the magnetic material have an average particle diameter in a range of 0.20 μm to 0.40 μm, since when the average particle diameter of the magnetic material is in this range, the magnetic material can be appropriately dispersed in the resin so that the magnetic material can be used instead of a black coloring agent such as carbon black, with a sufficient coloring degree.

When the average particle diameter of the magnetic material is less than 0.20 μm, the magnetic material tends to aggregate within the resin, or the fogging of the background of image caused by the poor dispersion of the magnetic material occurs, while when the average particle diameter of the magnetic material is more than 0.40 μm, a problem occurs with respect to the coloring degree.

Furthermore, in the above-mentioned image formation apparatus of the present invention, it is preferable that the toner have a saturation magnetization of 10 emu/g to 25 emu/g, more preferably 12 emu/g to 22 emu/g. When the saturation magnetization is less than 10 emu/g, the improvement effect of the fogging of the background due to the magnetic bias effect is low, while when the saturation magnetization is more than 25 emu/g, the magnetic bias effect is so great that the development performance extremely drops, and a problem is caused with respect to image density.

Furthermore, in the above-mentioned image formation apparatus of the present invention, it is preferable that the binder resin comprise as the main component a polyester resin, and have such a molecular weight distribution that has at least one peak within a range of 1,000 to 10,000 in the molecular weight distribution and a half peak width of 15,000 or less in terms of the molecular weight thereof, which molecular weight distribution is determined by subjecting a THF-soluble component contained in the toner to gel permeation chromatography (GPC), and it is preferable that the toner contain therein a THF-insoluble component in an amount of 2 wt. % to 40 wt. % of the toner. This is because when the above-mentioned conditions are met, there can be obtained a toner which is capable of performing the low-temperature image fixing and is free from the problem of the toner deposition on the background of image.

Furthermore, in the above-mentioned image formation apparatus, it is preferable that the toner particles of the toner have a volume mean diameter of 2.5 μm to 10 μm in order to obtain images with high quality which are excellent in the reproducibility of thin line images, although there is no particular limitation to the diameter of the toner particles.

When the particular magnetic material as used in the present invention is contained in the toner, the toner can be easily pulverized when the toner is produced, so that the particle diameter of the toner particles can be easily reduced and therefore high quality images can be easily obtained.

In the present invention, the measurement by gel permeation chromatography (GPC) is carried out in the following manner:

A column is stabilized in a heated chamber of 40° C., and tetrahydrofuran (THF) serving as a solvent is caused to pass through the column at a flow rate of 1 ml per minute at 40° C. 50 μl to 200 μl of a THF solution containing 0.05 wt. % to 0.6 wt. % of a sample resin is injected into the column. The molecular weight distribution of the sample resin is determined by the calculation based on the relationship between a logarithmic value and a count number read from a calibration curve. The calibration curve is obtained by plotting the logarithmic values and the count numbers of several kinds of monodisperse polystyrene standard samples. For calibration, the following polystyrene standard samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are available from, for example, Pressure Chemical Co., or Tosoh Corporation, can be used. It is proper to use at least about ten standard polystyrene samples for preparing the calibration curve. A refractive index detector is used for the measurement.

The amount of the THF-insoluble component can be measured as follows:

About 1.0 g of a binder resin sample is weighed, and about 50 g of THF is added thereto. The mixture is allowed to stand at 20° C. for 24 hours. The mixture is centrifuged and filtered, using a filter paper for chemical analysis (made according to the Japanese Industrial Standards P3801, Class 5 C), at room temperature. The residue which remains on the filter paper is the THF-insoluble component. The weight ratio of the residue to the toner employed is calculated in terms of wt. %.

The amount of the THF-insoluble component in the binder resin contained in the toner can be measured, using about 1 g of the toner, in the same manner as mentioned above. In this case, however, since in the residue, solid materials such as a pigment are contained, the amount of the THF-insoluble component is separately measured by a thermal analysis.

The glass transition point (Tg) of the binder resin can be measured by a commercially available tester—(Trademark "RIGAKU THERMOFLEX TG8110" made by Rigaku Denki Company, Ltd.) with a temperature elevation rate of 10° C./min.

The melting point of the binder resin for use in the present invention is determined, using a commercially available flow testing instrument (Trademark "CAPILLARY RHEOMETER SHIMADZU FLOWMETER CFT-500D" made by Shimadzu Corporation), under the conditions that the dies diameter is 1 mm, the applied pressure is 20 kg/cm$^2$, and the temperature elevation rate is 6° C./min. The melting point measured corresponds to a ½ point in the temperature range from the flow-initiating temperature to the flow-terminating point of a sample (1 cm$^3$) which is fused and caused to flow.

Specific examples of the binder resins for use in the toner include homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylethyl ether copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer.

Further, the following resins may be used in combination: poly(methyl methacrylate), poly(butyl methacrylate), poly (vinyl chloride), poly(vinyl acetate), polyethylene, polypropylene, polyester, polyurethane, polyamide, epoxy resin, poly(vinyl butyral), polyacrylic acid resin, rosin, modified rosin, terpene resin, phenolic resin, aliphatic or alicyclic hydrocarbon resin, aromatic petroleum resin, chlorinated paraffin, and paraffin wax.

In particular, the following binder resins are suitable for the image fixing by the application of pressure: polyolefins such as low-molecular-weight polyethylene, low-molecular-weight polypropylene, and polyethylene oxide polyethylene tetrafluoride; epoxy resin; polyester resin; styrene-butadiene copolymer (with a monomer ratio of 5:95 to 30:70); olefin copolymers such as ethylene-acrylic acid copolymer, ethylene-acrylic acid ester copolymer, ethylene-methacrylic acid copolymer, ethylene-methacrylic acid ester copolymer, ethylene-vinyl chloride copolymer, ethylene-vinyl acetate copolymer, and ionomer resin); polyvinyl pyrrolidone; methyl vinyl ether-maleic anhydride copolymer; maleic-acid-modified phenolic resin; and phenol-modified terpene resin. There resins may be used alone or in combination.

The method for preparing the above-mentioned resins is not particularly limited, but may also include bulk polymerization, solution polymerization, emulsion polymerization, and suspension polymerization.

In view of the heat-resistant shelf stability of the obtained toner, it is preferable that the above-mentioned resins for use in the present invention have a glass transition temperature (Tg) of 55° C. or more, and more preferably 60° C. or more.

Examples of the magnetic material for use in the magnetic toner of the present invention include iron oxides such as magnetite, hematite and ferrite; metals such as iron, cobalt, and nickel; alloys of the above-mentioned metals with aluminum, cobalt, copper, lead, magnesium, tin, zinc, antimony, beryllium, bismuth, cadmium, calcium, manganese, selenium, titanium, tungsten and vanadium; and mixtures of the above-mentioned metals and alloys.

Of the above-mentioned magnetic materials, magnetite is most preferable in view of the magnetic characteristics thereof.

In the present invention, as mentioned above, the magnetic material is subjected to surface coating treatment, with a coloring agent being coated on the surface of the magnetic material before the magnetic material is used in the toner.

For the above-mentioned surface coating treatment, using the coloring material, there can be employed, for example, a method of fixing the coloring agent to the surface of the magnetic material by treating the magnetic material in a mixer, applying an impact on the surface of the magnetic material in a high speed stream of gas, or by a dry type mechano-chemical method, or by a method of using a polysiloxane or the like as a glue. The surface coating treatment is not limited to these methods.

It is preferable that the amount of the coloring agent used in the surface coating treatment be 5 to 20 wt. %, more preferably 8 to 15 wt. %.

Furthermore, it is preferable that the shape of the magnetic material be spherical.

The average particle diameter of the magnetic material can be determined by measuring the actual particle diameters of 50 samples of the particles of the magnetic material, which are taken at random, by use of a scanning electron microscope.

Specific examples of the coloring agent for coating the surface of the magnetic material for use in the present invention are black dyes and pigments, such as carbon black, lamp black, black iron oxide, Aniline Black, graphite, and fullerene, dyes and pigments/chemical compounds, which assume a black color when used in combination, and other conventional black dyes and pigments which can be used alone or in combination. Of these dyes and pigments, carbon black is most advantageous for use in the present invention in terms of the degree of blackness.

With the color of the magnetic material itself taken into consideration, coloring agents such as blue dyes and pigments such as Aniline Blue and Phthalocyanine Blue, which are capable of blackening the magnetic material using their reddish color as complimentary color can also be employed.

The blackness of the toner of the present invention in which the blackened magnetic material is used can be represented by a particular CIE L*ab color space, in which it is preferable that the upper limit value of L* be 24.0, more preferably 23.0 or less, furthermore preferably 21.0 or less, and that the values of a and b be ±1.5 or less, more preferably ±1.0 or less. When the value of L* exceeds 24.0, the lightness is increased, so that the degree of blackness of the toner is lowered. When the values of a and b exceed ±1.5, the color withdraws from the black color in the color space, so that the degree of blackness is lowered. The value of the L*ab of the toner can be measured by measuring a solid image formed from the toner on a sheet of paper, using a measuring instrument "X-RITE 938" (trademark), made by X-Rite, Incorporated.

Examples of the coloring agent for use in the toner of the present invention are conventional dyes and pigments, which can be used alone or in combination, such as carbon black, lamp black, black iron oxide, Aniline Blue, Phthalocyanine Blue, Phthalocyanine Green, Hansa Yellow G, Rhodamine 6C Lake, Calconyl Blue, Chrome Yellow, quinacridone, Benzidine Yellow, Rose Bengale, and triallylmethane dye. The toner of the present invention can be used either as a monochrome black toner or as a black toner for full-color toners. It is preferable that the amount of such a coloring agent be 1 wt. % to 30 wt. %, more preferably 3 to 20 wt. % of the entire resin component of the toner.

Any conventional release agents can be used for the toner of the present invention. In particular, a carnauba wax free of free aliphatic acids, montan wax, and oxidized rice bran wax can be used alone or in combination as the release agent.

As the carnauba wax, carnauba wax in a microcrystalline state is preferable for use in the present invention. A more preferable carnauba wax is one with an acid value of 5 or less and a particle diameter of 1 μm or less when dispersed in the binder resin for the toner.

The term "montan wax" generally refers to a montan based wax which is purified from a mineral. It is preferable that the montan wax for use in the present invention be in a microcrystalline form in the same manner as in the carnauba wax, and have an acid value of 5 to 14. As the release agent for use in the toner of the present invention, other conventional release agents such as solid silicone varnish, higher fatty acid, higher alcohol, montan based ester wax, and low-molecular-weight propylene wax can be used in the form of a mixture.

It is preferable that the amount of the release agent be in the range of 1 to 20 parts by weight, more preferably in the range of 3 to 10 parts by weight, with respect to 100 parts by weight of the binder resin for use in the toner.

When necessary, a charge control agent and a fluidity improving agent can be added to the toner of the present invention.

As the charge control agent, any conventionally known charge control agents can be employed in the toner of the present invention. Specific examples of positive charge control agents are nigrosine, basic dye, lake pigment of basic dye, and quaternary ammonium chloride compound. Specific examples of negative charge control agents are metal salt of monoazo dye, and metal complexes of salicylic acid, naphthoic acid, and dicarboxylic acid.

A hydrophobic inorganic powder can also be used in the toner of the present invention. As the hydrophobic inorganic powder, all of the conventionally known hydrophobic inorganic powders can be employed. Of such hydrophobic inorganic powders, for example, hydrophobic silica powder and hydrophobic titanium powder are preferable for use in the present invention. As the hydrophobic silica powder for use in the present invention, all of the conventionally known hydrophobic silica powders can be employed.

Examples of agents for making the above materials hydrophobic are silane coupling agent, silicone varnish, silicone oil, organic silicone compound, and materials having functional groups. Specific examples thereof are hexamethyl disilazane, hexamethylene disilazane, trimethylsilane, trimethylchlorosilane, trimethyl-ethoxysilane, dimethyl dichlorosilane, methyl trichloro-silane, benzyl dimethyl chlorosilane, chloromethyl dimethyl chlorosilane, dichlorodimethylsilane, triorganosilylmercaptan, trimethylsilylmercaptan, vinyldimethylacetoxysilane, dimethyl ethoxysilane, dimethyl dimethoxysilane, diphenyl diethoxysilane, aminopropyltrimethoxysilane, dipropylaminopropyl-trimethoxysilane, dibutylaminopropyltrimethoxysilane, dibutylaminopropylmethyldimethoxysilane, and trimethoxysilyl-γ-propylphenylamine.

Specific examples of silicone oil are methyl silicone oil, dimethyl silicone oil, phenylmethyl silicone oil, chlorophenyl methyl silicone oil, alkyl-modified silicone oil, aliphatic acid-modified silicone oil, amino-modified silicone oil, and polyoxyalkyl-modified silicone oil.

The above materials can be used alone or in combination.

In the hydrophobic treatment, either a single treatment or a composite treatment can be employed.

As the hydrophobic titanium powder, all of the conventionally known titanium powders can be employed in the present invention.

As the surface treatment agent for use in the present invention, there can be employed various silicone oils such as methyl hydrogen polysiloxane, dimethyl polysiloxane, and methylphenyl polysiloxane; various alkylsilane trifluoromethylethyl trimethoxy-silanes such as methyl trimethoxysilane, ethyl trimethoxysilane, hexyl trimethoxysilane, octyl trimethoxysilane, decyl trimethoxysilane, octadecyl trimethoxysilane, dimethyl dimethoxysilane, octyl triethoxysilane, and n-octadecyl dimethyl(3-(trimethoxysilyl)propyl)ammonium chloride; and various fluoroalkylsilanes such as heptadecafluorodecyl trimethoxysilane. In particular, various metal coupling agents such as silane-, titanium-, and alumina-zirconia-based coupling agents, represented by silane coupling agents such as vinyl trimethoxysilane, and γ-aminopropyl trimethoxysilane can be used in combination.

The toner of the present invention may further comprise other additives when necessary. Examples of the additives include lubricants such as "TEFLON" polymer and zinc stearate; abrasives such as cerium oxide and silicon carbide; fluidity-imparting agents or caking inhibitors such as colloidal silica and aluminum oxide; electroconductivity-imparting agents such as carbon black and tin oxide; and a fixing-promoting agent such as a low-molecular weight polyolefin.

The toner of the present invention can be used either as a mono-component toner or a toner for the two-component developer, and also either as a monochrome black toner or as a black toner for full-color toners.

In the case where the toner of the present invention is used as a toner for a two-component developer, the carrier core particles for the carrier can be classified into (1) magnetic core particles, each of which magnetic core particles is substantially composed of only a magnetic material such as magnetic ferrite, and (2) magnetic-material-dispersed resin core particles in which a number of finely-divided magnetic particles are dispersed in a resin.

In the case of the magnetic core particles, as the magnetic material which forms the core particles, there can be employed magnetic metals such as iron, nickel and cobalt, alloys thereof, and alloys containing rare earth elements; soft ferrites such as hematite, magnetite, manganese-zinc based ferrites, nickel-zinc based ferrite, manganese-magnesium based ferrite, and lithium based ferrite; iron based oxides such as copper-zinc ferrite, and mixtures thereof.

Furthermore, there can be employed other iron based alloys such as iron-silicon based alloy, iron-aluminum based alloy, iron-silicon aluminum based alloy, and permalloy.

In the present invention, it is preferable to employ magnetic ferrite core particles containing at least one element selected from the group of the elements of IA, IIA, IIIA, IVA, VA, VIA, IB, IIB, IIIB, IVB, VB, VIB, VIIB and VIII, with the content of other elements being less than 1 wt. %.

The magnetic core particles for use in the present invention can be produced by a sintering method or an atomizing method, when necessary, with the particle diameter distribution of the magnetic particles being made sharp, or with predetermined magnetic characteristics being imparted thereto by controlling, for instance, sintering temperature, temperature elevation rate, and heat application time.

There is no particular limitation to the specific resistance of the magnetic core particles for use in the present invention as long as the magnetic core particles satisfy the desired magnetic characteristics. However, it is preferable to use ferrite particles or magnetite particles with a specific resistance in the range of $10^5$ Ω·cm to $10^{10}$ Ω·cm.

In the case of the magnetic-material-dispersed resin core particles, the magnetic material therefor, there can be employed, for example, alloys and compounds of ferromagnetic metals such as iron, cobalt, and nickel.

As the resin to be coated in the form of powder on the surface of the carrier particles, there can be employed, for example, styrene-acrylic copolymer resin, silicone resin, maleic resin, fluorine-containing resin, polyester resin, and epoxy resin. When the above-mentioned styrene-acrylic copolymer resin is used for coating the carrier particles, it is preferable to use the copolymer containing a styrene component in a range of 30 wt. % to 90 wt. %. This is because when the content of the styrene component is less than 30 wt. %, the development performance tends to be lowered, while when the content of the styrene component is more than 90 wt. %, the coated layer tends to become hard and apt to be peeled off, so that the life of the carrier tends to be shortened.

The resin film coated on the carrier particles may comprise an adhesion promoting agent, a curing agent, a lubricant, an electroconductive material, and a charge control agent.

When the toner of the present invention is used either as a toner for a mono-component developer, or as a toner for a two-component developer, the toner is generally placed in a container, and put on the market separately from an image formation apparatus. The image formation apparatus is equipped with the container filled with the toner by the user for image formation.

The present invention provides a container holding therein the toner, which is not limited to a particular shape. For instance, the conventionally used bottle-shaped container and cartridge type container can be used for the toner of the present invention.

The present invention also provides an image formation apparatus using the toner of the present invention. In this case, the image formation apparatus of the present invention may be designed to produce images by electrophotography, and, for example, copying machines and printers are included in the image formation apparatus.

With reference to FIG. 1, an image formation apparatus of the present invention, in which a development unit of the present invention is incorporated, will now be explained. This image formation apparatus is the one made by modifying a commercially available copying machine (Trademark "MF-200" made by Ricoh Company, Ltd.) so as to incorporate the development unit of the present invention.

A development unit 13, which is disposed beside a photoconductor drum 1 which serves as a latent electrostatic image bearing member, is mainly composed of a support case 14, a development sleeve 15 which serves as a developer bearing member, a developer holding member 16, and a first doctor blade 17 which serves as a developer regulating member.

The support case 14 has a toner supplying opening 20 directed to the photoconductor drum 1 and constitutes a toner hopper 19 which serves as a toner holding portion for holding toner 18 therein. In the toner hopper 19, on the side of the photoconductor drum 1, a developer holding member 16 is disposed, which forms a developer holding portion 16*a* for holding therein a developer 22 which is composed of the toner 18 and a carrier made of magnetic particles. The developer holding member 16 and the support case 14 are integrally disposed.

In the support case 14, which is situated below the developer holding member 16, there is formed a projected portion 14*a* having a facing surface 14*b*. The space formed between the lower portion of the developer holding member 16 and the facing surface 14*b* constitutes the toner supplying opening 20 for supplying the toner 18 therethrough.

Inside the toner hopper 19, there is disposed a toner agitator 21 which is driven in rotation by driving means (not shown) and serves as toner supplying means. The toner agitator 21 transports the toner 18 within the toner hopper 19 toward the toner supplying opening 20, while agitating the toner 18.

In the toner hopper 19, on the side opposite to the photoconductor drum 1, there is disposed toner end detecting means 14*c* which is capable of detecting when the amount of the toner 18 in the toner hopper 19 is decreased to a predetermined level.

In the space between the photoconductor drum 1 and the toner hopper 19, there is disposed the development sleeve 15. The development sleeve 15 is driven in rotation in the direction of the arrow by driving means (not shown) and includes an inner magnet (not shown) serving as magnetic field generation means, which inner magnet is disposed in such a manner that the relative position thereof to that of the development unit 13 is not changed.

The first doctor blade 17 is integrally attached to the developer holding member 16 on the side opposite to the side to which the support case 14 is attached. The first doctor blade 17 is disposed so as to maintain a predetermined gap between the top edge of the first doctor blade 17 and the outer peripheral surface of the development sleeve 15.

A second doctor blade 23 serving as a developer regulating member is disposed at a portion of the developer holding member 16 near the toner supplying opening 20. The second doctor blade 23 is disposed in such a posture so as to maintain a predetermined gap between the free end of the second doctor blade 23 and the outer peripheral surface of the development sleeve 15, directed in such a direction that the flow of a layer of the developer 22 formed on the surface of the development sleeve 15 is hindered, with the free end of the second doctor blade 23 being directed to the center of the development sleeve 15 and with a base portion of the second doctor blade 23 being integrally fixed to the developer holding member 16.

The developer holding portion 16 is constructed so as to include a sufficient space for having the developer 22 circulated therein within a range in which the magnetic force of the development sleeve 15 reaches.

The facing surface 14*b* is formed so as to have a predetermined length l, inclined downward in the direction from the side of the toner hopper 19 toward the development sleeve 15, whereby when there occur vibrations, an unevenness in the distribution of the magnetic force of the magnet (not shown) which is disposed inside the development sleeve 15, and a partial increase in the toner concentration in the developer 22, and the carrier within the developer holding portion 16*a* is dropped from the gap between the second doctor blade 23 and the peripheral surface of the development sleeve 15, the dropped carrier is received by the facing surface 14*b*, then moved toward the development sleeve 15, magnetically attracted to the development sleeve 15, attached thereto, and then supplied into the developer holding portion 16*a*. Thus, the decreasing of the amount of the carrier within the developer holding portion 16*a* can be prevented, and the occurrence of the unevenness in the image density in the axial direction of the development sleeve 15 can also be prevented. It is preferable that the inclination angle α of the facing surface 14*b* be about 5°, and the length of the facing surface 14*b* be 2 mm to 20 mm, more preferably about 3 mm to about 10 mm.

The toner 18 carried by the toner agitator 21 within the toner hopper 19 is caused to pass through the toner supplying opening 20, supplied to the developer 22 which is borne by the development sleeve 15, and carried into the developer holding portion 16*a*. The developer 22 within the developer holding portion 16*a* is carried by the development sleeve 15 and transported to a position where the developer 22 faces the outer peripheral surface of the photoconductor drum 1, and only the toner is electrostatically attracted to a latent electrostatic image formed on the photoconductor drum 1 and bonded thereto, whereby a toner image is formed on the photoconductor drum 1.

Figure 2:
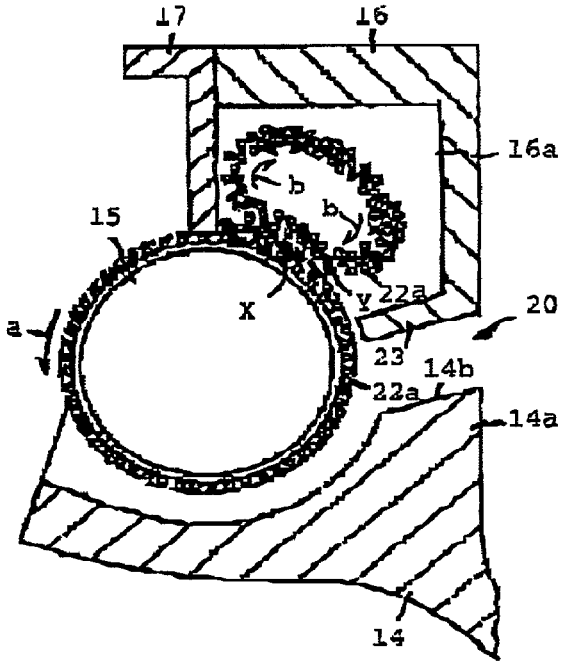
FIG. 2 is a partial schematic cross-sectional view of the image formation apparatus of the present invention in explanation of the movements of the developer at the time of the formation of a toner image.

The movements of the developer 22 at the time of the formation of the toner image will now be explained. As shown in FIG. 2, when a start agent composed of only a magnetic carrier 22*a* is placed in the development unit 13, the magnetic carrier 22*a* is separated into a magnetic carrier which is magnetically attached to the surface of the development sleeve 15, and a magnetic carrier which is held in the developer holding portion 16*a*. The magnetic carrier 22*a* held in the developer holding portion 16*a* is circulated therein in the direction of the arrows b by the magnetic force from within the development sleeve 15 in accordance with the rotation of the development sleeve 15 in the direction of the arrow a. As a result, there is formed an interface X between the surface of the magnetic carrier 22*a* which is magnetically attached to the surface of the development sleeve 15 and the surface of the magnetic carrier 22*a* which is circulated within the developer holding portion 16*a*.

When the toner 18 is placed in the toner hopper 19, the toner 18 is supplied from the toner supplying opening 20 to the magnetic carrier 22*a* which is held on the development sleeve 15. As a result, the development sleeve 15 carries thereon the developer 22 which is a mixture of the toner 18 and the magnetic carrier 22*a*. The developer 22 held within the developer holding portion 16*a* works so as to hinder the transportation of the developer 22 transported by the development sleeve 15. When the toner 18 which is present on the surface of the developer 22 held by the development sleeve 15 is transported and reaches the interface X, the friction between the developers 22 near the interface X is reduced and the transportation force of the developer 22 near the interface X is also reduced, so that the amount of the developer 22 transported near the interface X is decreased.

On the other hand, the developer 22 which exists upstream of the meeting point Y of the two developers 22 in terms of the rotating direction of the development sleeve 15 does not receive such force as to hinder the transportation of the developer 22 which is transported by the development sleeve 15 as in the above-mentioned developer holding portion 16*a*, so that there is lost the balance between the amount of the developer 22 transported up to the meeting point Y and the amount of the developer 22 which is being transported along the interface X, and the particles of the developer 22 come to hit each other successively like billiard balls, so that the position of the meeting point Y is moved upward, and the thickness of the layer of the developer 22 near there is increased.

Furthermore, the thickness of the layer of the developer 22 which has passed over the first doctor blade 17 is gradually increased, and the increased developer 22 is scraped off by the second doctor blade 23.

When the developer 22 which has passed over the first doctor blade 17 reaches a predetermined toner concentration, the increased portion of the developer 22 in the form of a layer, scraped by the second doctor blade 23, stops up the toner supplying opening 20. In this state, the incorporation of the toner 18 is terminated. At this moment, the toner concentration in the developer holding portion 16 is increased, whereby the volume of the developer 22 is increased. As a result, the space within the developer holding portion 16*a* is made small, and the circulation speed of the developer 22 in the direction of the arrow b is decreased.

In the layer of the developer 22 formed so as to stop up the toner supplying opening 20, the developer 22 scraped off by the second doctor blade 23 moves and is received by the facing surface 14*b*. Since the facing surface 14*b* is inclined downward at an angle α toward the development sleeve 15 and has a predetermined length, there can be prevented the dropping of the developer 22 into the toner hopper 19 due to the movement of the developer 22, so that the amount of the developer 22 can be always kept constant and therefore the supplying of the toner can be self-controlled so as to be always constant.

Other features of this invention will become apparent in the course of the following description of exemplary embodiments, which are given for illustration of the invention and are not intended to be limiting thereof.

[Preparation of Blackened Magnetic Material No. 1]

To magnetite particles "MTS-305" (trademark), made by Toda Kogyo Corporation, carbon black was added in an amount ratio by weight of 8 wt. %. Using a commercially available mill "MECHANOMILL" (trademark), made by Okada Seiko Co., Ltd., or "MECHANOFUSION SYSTEM" (trademark), made by Hosokawa Micron Corporation, the carbon black particles were fixed on the surfaces of the magnetite particles, thereby preparing a blackened magnetic material No. 1.

[Preparation of Blackened Magnetic Material No. 2]

To magnetite particles "MTS-305" (trademark), made by Toda Kogyo Corporation, aniline black was added in an amount ratio by weight of 8 wt. %. Using a commercially available mill "MECHANOMILL" (trademark), made by Okada Seico Co., Ltd., or "MECHANOFUSION SYSTEM" (trademark), made by Hosokawa Micron Corporation, the aniline black particles were fixed on the surfaces of the magnetite particles, thereby preparing a blackened magnetic material No. 2.

[Preparation of Carrier A]

100 parts by weight of a silicone resin solution (trademark "SR2411", made by Dow Corning Toray Silicone Co., Ltd.), 4 parts by weight of carbon black, and 100 parts by weight of toluene were dispersed using a homomixer for 30 minutes to prepare a liquid for the formation of a resin film.

The thus obtained liquid for the formation of a resin film and 1000 parts by weight of spherical ferrite particles with an average particle diameter of 80 μm were set in a fluidized bed coating apparatus, so that the ferrite particles were coated with the resin film. Thus, a carrier A was prepared.

[Preparation of Toner]

EXAMPLE 1

(Preparation of toner)

| | Parts by weight |
|---|---|
| Polyester resin (Mw: 104,100, Tg: 66° C., chloroform insoluble content: 5%, peak molecular weight: 15,000) | 85 |
| Styrene - methyl acrylate | 15 |
| Carbon-coated magnetic material No. 1 (average particle diameter: 0.23 μm) | 30 (21.9 wt %) |

-continued

| (Preparation of toner) | Parts by weight |
|---|---|
| Carbon black | 3 (2.1 wt. %) |
| Low-molecular weight polypropylene | 5 |
| Metal-containing azo compound | 2 |

A mixture of the above components was thoroughly stirred and blended in a "HENSCHEL MIXER" (trademark) mixer, and fused and kneaded in a roll mill at 130 to 140° C. for about 30 minutes. After the kneaded mixture was cooled to room temperature, the resultant mixture was pulverized using a jet mill pulverizer or mechanical pulverizer, and classified using a classifier by use of air flow.

Thus, toner matrix particles with a volume mean diameter of 9.0 μm were obtained. A commercially available hydrophobic silica was added in an amount ratio of 0.7 wt. % to the above prepared toner matrix particles, whereby a toner No. 1 according to the present invention was obtained. The saturation magnetization of the toner No. 1 was 15.2 emu/g. The main peak in the molecular weight distribution of the toner No. 1 was observed at 10,000, and the half peak width in molecular weight distribution was 300,000. The content insoluble in THF was 0% of the total weight of the toner No. 1.

4.0 parts by weight of the toner No. 1 and 96.0 parts by weight of the carrier A were mixed in a ball mill to provide a two-component developer No. 1 according to the present invention.

EXAMPLE 2

The procedure for preparation of the toner No. 1 in Example 1 was repeated except that volume mean diameter of the toner matrix particles was changed from 9.0 to 12.0 μm and that the amount ratio of the hydrophobic silica was changed from 0.7 to 0.5 wt. %. Thus, a toner No. 2 according to the present invention was obtained.

Using the above-mentioned toner No. 2, a two-component developer No. 2 of the present invention was produced in the same manner as in Example 1.

EXAMPLE 3

The procedure for preparation of the toner No. 1 in Example 1 was repeated except that volume mean diameter of the toner matrix particles was changed from 9.0 to 7.0 μm and that the amount ratio of the hydrophobic silica was changed from 0.7 to 0.9 wt. %. Thus, a toner No. 3 according to the present invention was obtained.

Using the above-mentioned toner No. 3, a two-component developer No. 3 of the present invention was produced in the same manner as in Example 1.

COMPARATIVE EXAMPLE 1

The procedure for preparation of the toner No. 1 in Example 1 was repeated except that the carbon-coated magnetic material No. 1 for use in the formulation for the toner No. 1 in Example 1 was replaced by a magnetic material not treated with carbon black. Thus, a comparative toner No. 1 was obtained.

Using the above-mentioned comparative toner No. 1, a comparative two-component developer No. 1 was produced in the same manner as in Example 1.

COMPARATIVE EXAMPLE 2

The procedure for preparation of the toner No. 1 in Example 1 was repeated except that the amount ratio of the carbon-coated magnetic material No. 1 for use in the formulation for the toner No. 1 in Example 1 was changed from 21.9 to 5 wt. %, and that the amount ratio of the carbon black was changed from 2.1 to 10 wt. %. Thus, a comparative toner No. 2 was obtained. The saturation magnetization of the obtained comparative toner No. 2 was 5.8 emu/g.

Using the above-mentioned comparative toner No. 2, a comparative two-component developer No. 2 was produced in the same manner as in Example 1.

COMPARATIVE EXAMPLE 3

The procedure for preparation of the toner No. 1 in Example 1 was repeated except that the amount ratio of the carbon-coated magnetic material No. 1 for use in the formulation for the toner No. 1 in Example 1 was changed from 21.9 to 50 wt. %. Thus, comparative toner No. 3 was obtained. The saturation magnetization of the obtained comparative toner No. 3 was 41.8 emu/g.

Using the above-mentioned comparative toner No. 3, a comparative two-component developer No. 3 was produced in the same manner as in Example 1.

EXAMPLE 4

The procedure for preparation of the toner No. 1 in Example 1 was repeated except that the amount ratio of the carbon-coated magnetic material No. 1 for use in the formulation for the toner No. 1 in Example 1 was changed from 21.9 to 36 wt. %. Thus, a toner No. 4 according to the present invention was obtained. The saturation magnetization of the obtained toner No. 4 was 31.2 emu/g.

Using the above-mentioned toner No. 4, a two-component developer No. 4 of the present invention was produced in the same manner as in Example 1.

EXAMPLE 5

The procedure for preparation of the toner No. 1 in Example 1 was repeated except that the average particle diameter of the carbon-coated magnetic material No. 1 for use in the formulation for the toner No. 1 in Example 1 was changed from 0.23 to 0.13 μm. Thus, a toner No. 5 according to the present invention was obtained. The saturation magnetization of the obtained toner No. 5 was 16.2 emu/g.

Using the above-mentioned toner No. 5, a two-component developer No. 5 of the present invention was produced in the same manner as in Example 1.

EXAMPLE 6

The procedure for preparation of the toner No. 1 in Example 1 was repeated except that the average particle diameter of the carbon-coated magnetic material No. 1 for use in the formulation for the toner No. 1 in Example 1 was changed from 0.23 to 0.35 μm. Thus, a toner No. 6 according to the present invention was obtained. The saturation magnetization of the obtained toner No. 6 was 15.0 emu/g.

Using the above-mentioned toner No. 6, a two-component developer No. 6 of the present invention was produced in the same manner as in Example 1.

EXAMPLE 7

| | Parts by weight |
|---|---|
| Polyester resin (Mw: 5,700, Tg: 63° C., THF insoluble content: 22%) | 100 |
| Low-molecular weight polypropylene (Trademark "VISCOL 550P", made by Sanyo Chemical Industries, Ltd.) | 5 |
| Blackened magnetic material No. 1 (average particle diameter: 0.23 μm) | 25 (18.8 wt %) |
| Carbon black (Trademark "#44", made by Mitsubishi Chemical Corporation) | 2 (1.5 wt %) |
| Metal-containing azo compound | 1 |

A mixture of the above components was thoroughly stirred and blended in a "HENSCHEL MIXER" (trademark) mixer, and fused and kneaded in a roll mill at 130 to 140° C. for about 30 minutes. After the kneaded mixture was cooled to room temperature, the resultant mixture was pulverized using a jet mill pulverizer or mechanical pulverizer, and classified using a classifier by use of air flow.

Thus, toner matrix particles with a volume mean diameter of 9.0 μm were obtained. A commercially available hydrophobic silica was added in an amount ratio of 0.7 wt. % to the above prepared toner matrix particles, whereby a toner No. 7 according to the present invention was obtained. The saturation magnetization of the toner No. 7 was 13.6 emu/g. The main peak in the molecular weight distribution of the toner No. 7 was observed at 7,900, and the half peak width in molecular weight distribution was 13,000. The content insoluble in THF was 18% of the total weight of the toner No. 7.

4.0 parts by weight of the toner No. 7 and 96.0 parts by weight of the carrier A were mixed in a ball mill to provide a two-component developer No. 7 according to the present invention.

EXAMPLE 8

The toner was produced in the same manner as in Example 7.

The procedure for preparation of the two-component developer No. 7 in Example 7 was repeated except that the 13.0 parts by weight of the toner were mixed with 87.0 parts by weight of the carrier A. Thus, a two-component developer No. 8 according to the present invention was obtained.

COMPARATIVE EXAMPLE 4

The procedure for preparation of the toner No. 7 in Example 7 was repeated except that the blackened magnetic material No. 1 for use in the formulation for the toner No. 7 in Example 7 was replaced by a magnetic material not treated with carbon black. Thus, a comparative toner No. 4 was obtained.

Using the above-mentioned comparative toner No. 4, a comparative two-component developer No. 4 was produced in the same manner as in Example 8.

EXAMPLE 9

The procedure for preparation of the toner No. 7 in Example 7 was repeated except that the amount ratio of the carbon black for use in the formulation for the toner No. 7 in Example 7 was changed from 1.5 to 8 wt. %. Thus, a toner No. 9 according to the present invention was obtained. The saturation magnetization of the obtained toner No. 9 was 12.3 emu/g.

Using the above-mentioned toner No. 9, a two-component developer No. 9 of the present invention was produced in the same manner as in Example 8.

EXAMPLE 10

The procedure for preparation of the toner No. 7 in Example 7 was repeated except that the carbon black was removed from the formulation for the toner No. 7 in Example 7. Thus, a toner No. 10 according to the present invention was obtained. The saturation magnetization of the obtained toner No. 10 was 21.9 emu/g.

Using the above-mentioned toner No. 10, a two-component developer No. 10 of the present invention was produced in the same manner as in Example 8.

EXAMPLE 11

The procedure for preparation of the toner No. 7 in Example 7 was repeated except that the amount ratio of the blackened magnetic material No. 1 for use in the formulation for the toner No. 7 in Example 7 was changed from 18.8 to 38 wt. %. Thus, a toner No. 11 according to the present invention was obtained. The saturation magnetization of the obtained toner No. 11 was 31.3 emu/g.

Using the above-mentioned toner No. 11, a two-component developer No. 11 of the present invention was produced in the same manner as in Example 8.

EXAMPLE 12

The procedure for preparation of the toner No. 7 in Example 7 was repeated except that the average particle diameter of the blackened magnetic material No. 1 for use in the formulation for the toner No. 7 in Example 7 was changed from 0.23 to 0.13 μm. Thus, a toner No. 12 according to the present invention was obtained. The saturation magnetization of the obtained toner No. 12 was 13.8 emu/g.

Using the above-mentioned toner No. 12, a two-component developer No. 12 of the present invention was produced in the same manner as in Example 8.

EXAMPLE 13

The procedure for preparation of the toner No. 7 in Example 7 was repeated except that the average particle diameter of the blackened magnetic material No. 1 for use in the formulation for the toner No. 7 in Example 7 was changed from 0.23 to 0.35 μm. Thus, a toner No. 13 according to the present invention was obtained. The saturation magnetization of the obtained toner No. 13 was 13.2 emu/g.

Using the above-mentioned toner No. 13, a two-component developer No. 13 of the present invention was produced in the same manner as in Example 8.

EXAMPLE 14

| | Parts by weight |
|---|---|
| Polyester resin (A) (Mw: 5,100, Tg: 63° C., THF insoluble content: 0%, softening point: 145° C., peak molecular weight: 4,100) | 50 |
| Polyester resin (B) (Mw: 6,200, Tg: 61° C., THF insoluble content: 30%, softening point: 100° C., peak molecular weight: 3,800) | 50 |
| Oxidized rice bran wax | 5 |
| Blackened magnetic material No. 2 (average particle diameter: 0.25 μm) | 30 (22.1 wt %) |
| Metal-containing azo compound | 1 |

A mixture of the above components was thoroughly stirred and blended in a "HENSCHEL MIXER" (trademark) mixer, and fused and kneaded in a roll mill at 130 to 140° C. for about 30 minutes. After the kneaded mixture was cooled to room temperature, the resultant mixture was pulverized using a jet mill pulverizer or mechanical pulverizer, and classified using a classifier by use of air flow.

Thus, toner matrix particles with a volume mean diameter of 6.8 μm were obtained. A commercially available hydrophobic silica was added in an amount ratio of 0.7 wt. % to the above prepared toner matrix particles, whereby a toner No. 14 according to the present invention was obtained. The saturation magnetization of the toner No. 14 was 17.3 emu/g. The main peak in the molecular weight distribution of the toner No. 14 was observed at 6,100, and the half peak width in molecular weight distribution was 10,000. The content insoluble in THF was 13% of the total weight of the toner No. 14.

13.0 parts by weight of the toner No. 14 and 87.0 parts by weight of the carrier A were mixed in a ball mill to provide a two-component developer No. 14 according to the present invention.

[Evaluations]

Each of the two-component developers prepared in Examples 1 to 7 and Comparative Examples 1 to 3 was set in a commercially available copying machine "MF-250" (trademark), made by Ricoh Company, Ltd. Each of the two-component developers prepared in Examples 8 to 14 and Comparative Example 4 was set in the above-mentioned copying machine "MF-200" (trademark), made by Ricoh Company, Ltd., which was modified so as to have a development unit with a structure as shown in FIG. 1.

Image formation was carried out to evaluate the properties of each developer from various angles as shown below. For the evaluation, the average was obtained from the results at the initial stage and the results produced after making of 140,000 copies.

(1) Fogging

A plain white paper without any toner image was subjected to the electrophotographic copying process to output a paper of A3 size. The A3-size paper thus outputted was evaluated in terms of the occurrence of fogging in such a manner that the optical densities of six portions arbitrarily chosen were measured with a "MACBETH" (trademark) reflection-type densitometer.

The evaluation of the occurrence of fogging was carried out on five levels according to the obtained density. When no fogging occurred, the obtained density was equal to the reflection density of the plain paper. The higher the density, the worse the performance of fogging.

The results are shown in TABLE 1. The evaluation criterion is as follows:

5: Excellent (No fogging occurred.)

4: Good

3: Fair

2: Poor

1: Very poor (2) Unevenness of Image Density

Using a chart entirely carrying halftone images, copies were continuously made on 15 sheets of paper (A4 size). The degree of unevenness in image density was visually inspected and evaluated on five levels.

The results are shown in TABLE 1. The evaluation criterion is as follows:

5: Excellent (The image density was even.)

4: Good

3: Fair

2: Poor

1: Very poor (3) Uniformity in Solid Image

Using a chart (A3 size) carrying six solid image portions thereon, image formation was carried out on a sheet of paper of A3 size. The image densities of the six solid image portions were measured with a "MACBETH" (trademark) reflection-type densitometer. The uniformity in solid image was evaluated on five levels according to the variation in the image densities at six positions.

The results are shown in TABLE 1. The evaluation criterion is as follows:

5: Excellent (Solid images were uniformly produced.)

4: Good

3: Fair

2: Poor

1: Very poor (4) Reproducibility of Thin Line image

With each two-component developer set in the copying machine, the reproducibility of thin line images was evaluated on five levels.

The results are shown in TABLE 1. The evaluation criterion is as follows:

5: Excellent (Thin line images were faithfully reproduced.)

4: Good

3: Fair

2: Poor

1: Very poor (5) Toner Fixing Properties

Each two-component developer was set in a commercially available copying machine "MF-200" (trademark), made by Ricoh Company, Ltd., equipped with an image fixing unit having a "TEFLON" polymer image fixing roller. The image fixing unit was modified so as to permit the surface temperature of the "TEFLON" polymer image fixing roller to be variously changed. With the surface temperature set to a predetermined temperature, toner images were produced on sheets of paper (trademark "TYPE 6200", made by Ricoh Company, Ltd.)

Thus, the cold-offset occurrence temperature and the hot-offset occurrence temperature were obtained.

For obtaining the cold-offset occurrence temperature, a toner-image-bearing paper was allowed to pass through the "TEFLON" polymer image fixing roller at a linear velocity of 120 to 150 mm/sec under a pressure of 1.2 kgf/cm$^2$, with a nip width being set to 3 mm. The cold-offset temperature indicates a lower limit temperature at which image fixing is permissible, and the image fixing lower limit temperature of conventional toners designed to be fixed at lower temperatures is in the range of about 140 to 150° C.

For obtaining the hot-offset occurrence temperature, a toner-image-bearing paper was allowed to pass through the "TEFLON" polymer image fixing roller at a linear velocity of 50 mm/sec under a pressure of 2.0 kgf/cm$^2$, with a nip width being set to 4.5 mm.

The evaluation of the image fixing performance at low temperatures was carried out on five levels according to the cold-offset occurrence temperature. The lower the cold-offset occurrence temperature, the better the image fixing performance at lower temperatures.

The results are also shown in TABLE 1. The evaluation criterion is as follows:

(Image Fixing Performance at Lower Temperatures)

5: cold-offset temp.<130° C.

4: 130° C.≦cold-offset occurrence temp.<140° C.

3: 140° C.≦cold-offset occurrence temp.<150° C.

2: 150° C.≦cold-offset occurrence temp.<160° C.

1: 160° C.≦cold-offset occurrence temp.

The evaluation of the anti-hot-offset performance was carried out on five levels according to the hot-offset occurrence temperature. The higher the hot-offset occurrence temperature, the better the anti-hot-offset performance.

The results are also shown in TABLE 1. The evaluation criterion is as follows:

(Anti-Hot-Offset Performance)

5: hot-offset occurrence temp.≧201° C.

4: 200° C.≧hot-offset occurrence temp.≧191° C.

3: 190° C.≧hot-offset occurrence temp.≧181° C.

2: 180° C.≧hot-offset occurrence temp.≧171° C.

1: 170° C.≧hot-offset occurrence temp.

TABLE 1

| | Volume Mean Diameter of Toner (μm) | Content of Magnetic Material (wt. %) | Saturation Magnetization of Toner (emu/g) | Average Particle Diameter of Magnetic Material (μm) | Fogging | Evenness in image density | Uniformity in solid image | Reproducibility of thin line | Image fixing at lower temperatures | Anti-hot-offset performance |
|---|---|---|---|---|---|---|---|---|---|---|
| Ex. 1 | 9.0 | 21.9 | 15.2 | 0.23 | 5 | 5 | 5 | 4 | 3 | 3 |
| Ex. 2 | 12.0 | 21.9 | 15.2 | 0.23 | 5 | 5 | 5 | 3 | 3 | 3 |
| Ex. 3 | 7.0 | 21.9 | 15.2 | 0.23 | 5 | 5 | 5 | 5 | 3 | 3 |
| Ex. 4 | 9.0 | 36.0 | 31.2 | 0.23 | 5 | 4~5 | 4 | 4 | 3 | 3 |
| Ex. 5 | 9.0 | 21.9 | 16.2 | 0.13 | 4 | 5 | 5 | 4 | 3 | 3 |
| Ex. 6 | 9.0 | 21.9 | 15.0 | 0.35 | 5 | 5 | 4 | 4 | 3 | 3 |
| Ex. 7 | 9.0 | 18.8 | 13.6 | 0.23 | 5 | 5 | 5 | 4 | 4 | 4 |
| Ex. 8 | 9.0 | 21.9 | 15.2 | 0.23 | 4~5 | 5 | 5 | 4 | 3 | 3 |
| Ex. 9 | 9.0 | 19.7 | 12.3 | 0.23 | 3 | 3 | 3 | 4 | 3 | 3 |
| Ex. 10 | 9.0 | 21.9 | 15.3 | 0.23 | 5 | 5 | 5 | 4 | 3 | 3 |
| Ex. 11 | 9.0 | 38.0 | 31.3 | 0.23 | 4~5 | 4~5 | 4 | 4 | 3 | 3 |
| Ex. 12 | 9.0 | 21.9 | 13.8 | 0.13 | 4 | 5 | 4 | 4 | 3 | 3 |
| Ex. 13 | 9.0 | 21.9 | 13.2 | 0.35 | 4~5 | 4~5 | 4 | 4 | 3 | 3 |
| Ex. 14 | 6.8 | 22.1 | 17.3 | 0.25 | 4~5 | 5 | 5 | 5 | 5 | 4 |
| Comp. Ex. 1 | 9.0 | 21.9 | 15.2 | 0.23 | 4~5 | 4 | 3 | 4 | 3 | 3 |
| Comp. Ex. 2 | 9.0 | 5.0 | 5.8 | 0.23 | 3 | 3 | 4 | 4 | 3 | 3 |
| Comp. Ex. 3 | 9.0 | 50.0 | 41.8 | 0.23 | 4 | 3 | 2~3 | 4 | 3 | 3 |
| Comp. Ex. 4 | 9.0 | 21.9 | 15.2 | 0.23 | 3~4 | 3 | 2~3 | 4 | 3 | 3 |

Japanese Patent Application No. 2000-103207 filed Apr. 5, 2000 is hereby incorporated by reference.

What is claimed is:

1. A toner for developing a latent electrostatic image to a toner image, said toner comprising (a) a binder resin, and (b) a magnetic material which is blackened by coating the surface of a magnetic powder with a coloring agent, said magnetic material being in an amount of 10 wt. % to 40 wt. % of the entire weight of said toner, wherein said binder resin in said toner comprises a polyester resin and has such a molecular weight distribution that has at least one peak within a range of 1,000 to 10,000 in said molecular weight distribution and a half peak width of 15,000 or less in terms of the molecular weight thereof, which molecular weight distribution is determined by subjecting a THF-soluble component contained in said toner to gel permeation chromatography (GPC), and said toner contains therein a THF-insoluble component in an amount of 2 wt. % to 40 wt. % of said toner.

2. An image formation apparatus comprising a development unit including a developer bearing member and a two-component developer comprising a toner and a magnetic carrier carried on said developer bearing member, said development unit being capable of changing addition of additional toner to said two-component developer on the developer bearing member by preventing or permitting supply of additional toner to said two-component developer on said developer bearing member in accordance with changes in concentration of toner in said two-component developer on said developer bearing member, wherein said toner comprises (a) a binder resin, and (b) a magnetic material which is blackened by coating the surface of a magnetic powder with a coloring agent, and wherein said binder resin in said toner comprises a polyester resin, and has such a molecular weight distribution that has at least one peak within a range of 1,000 to 10,000 in said molecular weight distribution and a half peak width of 15,000 or less in terms of the molecular weight thereof, which molecular weight distribution is determined by subjecting a THF-soluble component contained in said toner to gel permeation chromatography (GPC), and said toner contains therein a THF-insoluble component in an amount of 2 wt. % to 40 wt. % of said toner.

3. A toner container containing therein a toner for developing a latent electrostatic image to a toner image, said toner comprising (a) a binder resin, and (b) a magnetic material which is blackened by coating the surface of a magnetic powder with a coloring agent, said magnetic material being in an amount of 10 wt. % to 40 wt. % of the entire weight of said toner, wherein said binder resin comprises a polyester resin, and has such a molecular weight distribution that has at least one peak within a range of 1,000 to 10,000 in said molecular weight distribution and a half peak width of 15,000 or less in terms of the molecular weight thereof, which molecular weight distribution is determined by subjecting a THF-soluble component contained in said toner to gel permeation chromatography (GPC), and said toner contains therein a THF-insoluble component in an amount of 2 wt. % to 40 wt. % of said toner.

4. An image formation apparatus comprising a toner container which contains therein a toner for developing a latent electrostatic image to a toner image, said toner comprising (a) a binder resin, and (b) a magnetic material which is blackened by coating the surface of a magnetic powder with a coloring agent, said magnetic material being in an amount of 10 wt. % to 40 wt. % of the entire weight of said toner, wherein said binder resin in said toner comprises a polyester resin, and has such a molecular weight distribution that has at least one peak within a range of 1,000 to 10,000 in said molecular weight distribution and a half peak width of 15,000 or less in terms of the molecular weight thereof, which molecular weight distribution is determined by subjecting a THF-soluble component contained in said toner to gel permeation chromatography (GPC), and said toner contains therein a THF-insoluble component in an amount of 2 wt. % to 40 wt. % of said toner.

* * * * *